United States Patent [19]

Fujita

[11] 4,164,043

[45] Aug. 14, 1979

[54] FINGERLESS GLOVE

[76] Inventor: Satoru Fujita, 8-6-1, Arakawa, Arakawa-ku, Tokyo, Japan

[21] Appl. No.: 866,867

[22] Filed: Jan. 4, 1978

[51] Int. Cl.[2] ..... A41D 19/00

[52] U.S. Cl. ..... 2/161 A

[58] Field of Search ..... 2/159, 161 R, 161 A, 2/163, 165, 169

[56] References Cited

U.S. PATENT DOCUMENTS

| | | | |
|---|---|---|---|
| 888,009 | 5/1908 | Gitt | 2/169 |
| 1,915,617 | 6/1933 | Potter | 2/159 |
| 2,975,429 | 3/1961 | Newman | 2/161 A |
| 3,203,006 | 8/1965 | Shirly | 2/159 |
| 3,490,074 | 1/1970 | Hardy | 2/161 R |
| 3,606,614 | 9/1971 | Dititrott | 2/159 |

*Primary Examiner*—Werner H. Schroeder
*Assistant Examiner*—Doris L. Troutman
*Attorney, Agent, or Firm*—Connolly and Hutz

[57] ABSTRACT

A fingerless glove suitable for use in sport games particularly those in which rackets are used, e.g. tennis, squash, racket ball and so forth. The fingerless glove is characterized by comprising three gore tabs spaced from each other and projecting from the upper edge of the palm portion of the glove, the gore tabs being sewn to the back portion of the glove so as to define and form finger-insertion bores.

5 Claims, 4 Drawing Figures

FIG. 1
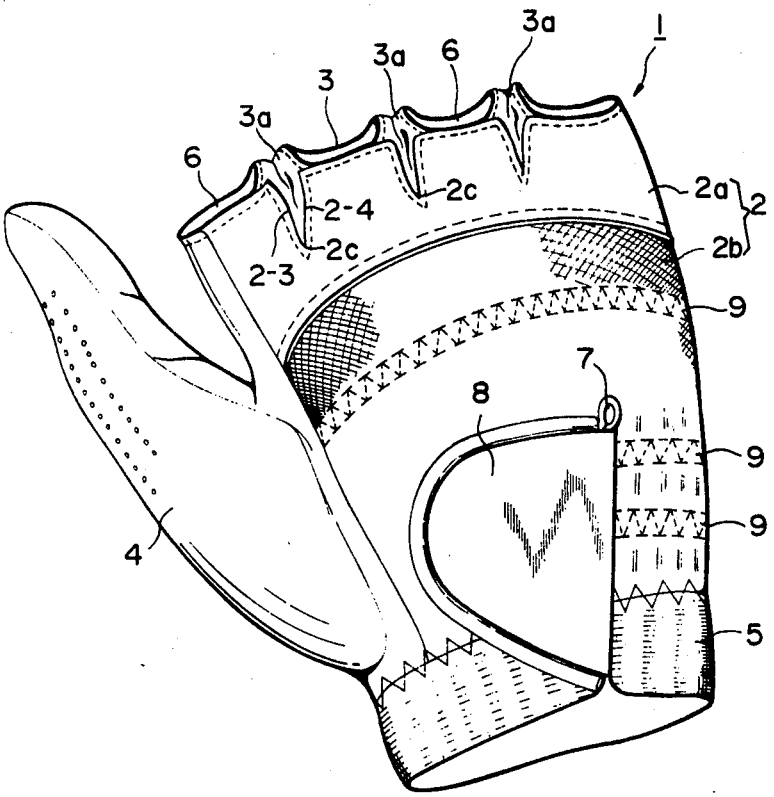
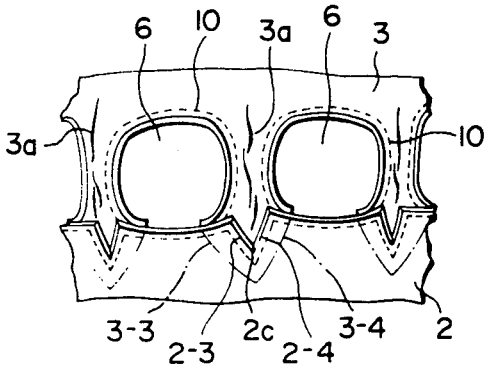
FIG. 3

FINGERLESS GLOVE

BACKGROUND OF THE INVENTION

The use of gloves for protecting the hands and preventing slipping of the grip has become popular in various sports and games. Generally speaking there are two types of gloves. One type envelops all portions of the hand including the fingers and the palm, and the other is the so-called fingerless glove adapted to envelop the palm portion of the hand and the lower parts of the fingers while allowing the tips of the fingers to be exposed. A modified glove adapted to envelop only specific fingers is more appropriately referred to as a sack rather than a glove.

The present invention relates to an improvement in the fingerless glove as mentioned above.

Conventional fingerless gloves are adapted to expose the fingers down to the first or second joint. Such fingerless gloves have a common disadvantage in that the material of the glove enveloping the base end portions of the fingers often turns up toward the palm side when the glove is frequently used for gripping a racket or a golf club. As the material is turned up, it is curled to assume the form of a strand at each finger and the strand is pressed onto the base portions of fingers by the grip of the racket or golf club, thereby irritating such portions, or at the least, imparting a bad feel of play. In addition, since a plurality of individual gore tab pieces are sewn together to extend between the fingers along the same, the smooth movement of the fingers is deteriorated, and the sewing work itself is rendered complicated and troublesome.

SUMMARY OF THE INVENTION

It is therefore an object of the invention to provide a fingerless glove lacking the portions for enveloping four fingers other than the thumb, so as to avoid the curling of the glove material at the finger portions.

It is another object of the invention to provide a fingerless glove in which three equally spaced gore tabs projecting from the upper end of the palm portion of the glove are sewed to the back portion of the glove, defining insertion bores for four fingers other than the thumb.

It is still another object of the invention to provide a fingerless glove in which gore tabs extending from the upper end of the palm portion and sewed to the back portion of the glove have various profiles.

BRIEF DESCRIPTION OF THE DRAWINGS

Novel features and advantages of the present invention in addition to those mentioned above will become apparent from a reading of the following detailed description in conjunction with the accompanying drawings wherein:

FIG. 1 is a perspective view of a fingerless glove according to the present invention viewed from the back side thereof;

FIG. 3 is a top plan view of the glove of FIG. 1 showing the finger-insertion bores.

DESCRIPTION OF THE PREFERRED EMBODIMENT

The fingerless glove of the present invention is most suitable for use in sports games in which rackets are used, e.g. tennis, squash, racket ball, badminton or the like, but it may also be used in other sports, e.g. golf.

Figure 2:
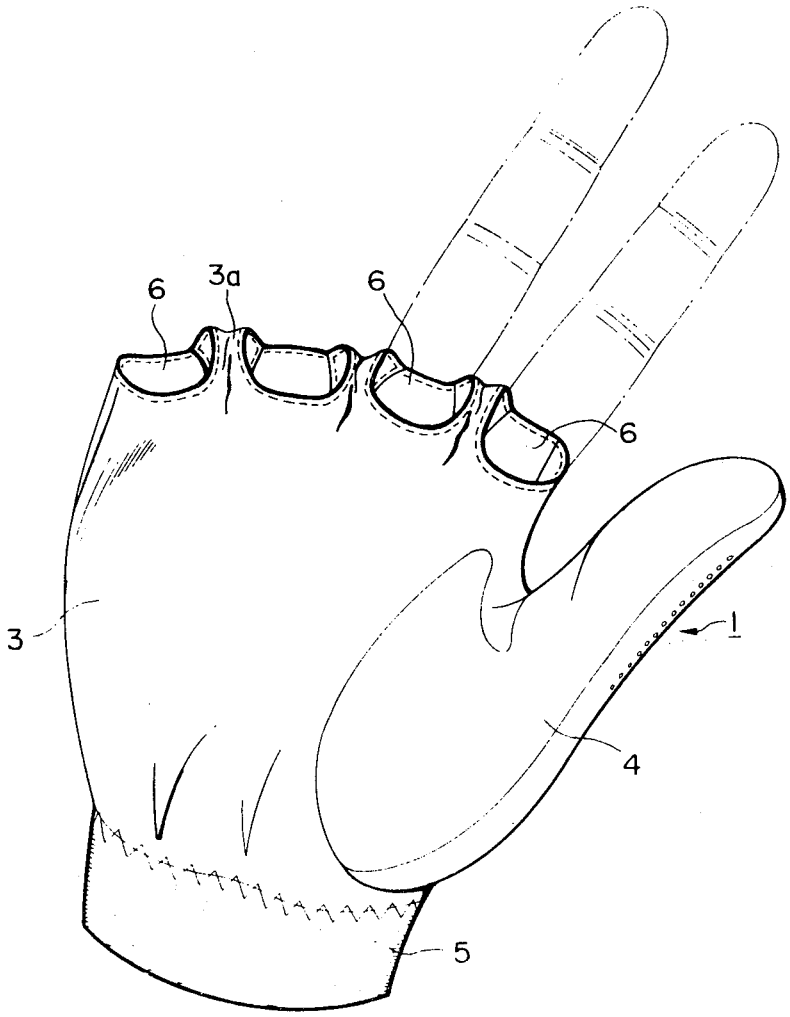
FIG. 2 is a perspective view of the glove shown in FIG. 1 viewed from the upper side thereof, showing fingers exposed through the finger-insertion bores.

Referring to the drawings, FIGS. 1 and 2 show a fingerless glove 1 embodying the invention as viewed from the back and palm sides, respectively. The glove 1 consists of a back portion 2, palm portion 3, thumb portion 4 and a fastening band portion 5 with elasticity. The upper half section of the back portion 2 is made of leather 2*a* and has vertical slits 2C, while the lower half section is made of mesh cloth 2*b* sewn to and along the lower edge of the leather 2*a*. However, the above stated combination of leather 2*a* and the mesh cloth 2*b* is not critical and other materials may be used. For example, the whole of the back portion 2 may be made of leather, and the section covered by the mesh cloth 2*a* eliminated. In this specification, the term "palm" or "palm portion" is used to denote the front part of a hand or glove other than the fingers. The palm section 3 is sewn from blank material which has been cut in a shape as shown best in FIG. 4, to which are sewn a back member, thumb member and a fastening belt member. From the upper edge of the palm member 3', three gore tabs 3*a* are projected which are spaced from each other and each of which has a substantially hexagonal shape with a widened mid portion.

The back member 2' (2*a*, 2*b*) and the palm member 3' are sewn to each other in the following manner. The sewing of other portions can be made in the conventional way and, therefore, is not described herein.

At first, side edges 2-1 and 2-2 of the back member 2' are sewn to the side edges 3-1 and 3-2 of the palm member 3', respectively. Subsequently, gore tabs 3*a* are sewn at their two edges 3-3 and 3-4 to both sides 2-3 and 2-4 of corresponding slit 2C. Thus, each slit 2C is open to thereby form a V-shaped notch.

By sewing each of the three spaced gore tabs 3*a* of the palm member 3' to the back member 2' in the described manner, four finger-insertion bores 6 are thereby formed at the upper edges of the palm portion 3 and back portions 2. It is essential that the gore tabs 3 be made of the same material as the palm member and extend continuously from the palm member. Although the gore tabs have been described as having a generally hexagonal profile, other profiles such as rectangular forms or tongue-like forms can be used as long as such forms open the slot in the form of the V-shaped notch when sewn to the slit 2C. Consequently, the peripheral edges of the finger-insertion bores 6 are so situated as to surround the base sections of respective fingers.

The portions of the gore tabs 3*a* connected to the palm portion 3 function to define these finger-insertion bores 6, as well as to connect the palm and back portions to each other. At the same time, the triangular end portion of each gore tab 3*a* plays the designated role of the gore, so as to spread the area of the back portion and to allow free movement of the fingers.

A thread or stitch 10 is sewn by machine to surround each finger-insertion bore 6 in order to prevent the leather around the bore from stretching and becoming elongated.

Figure 4:
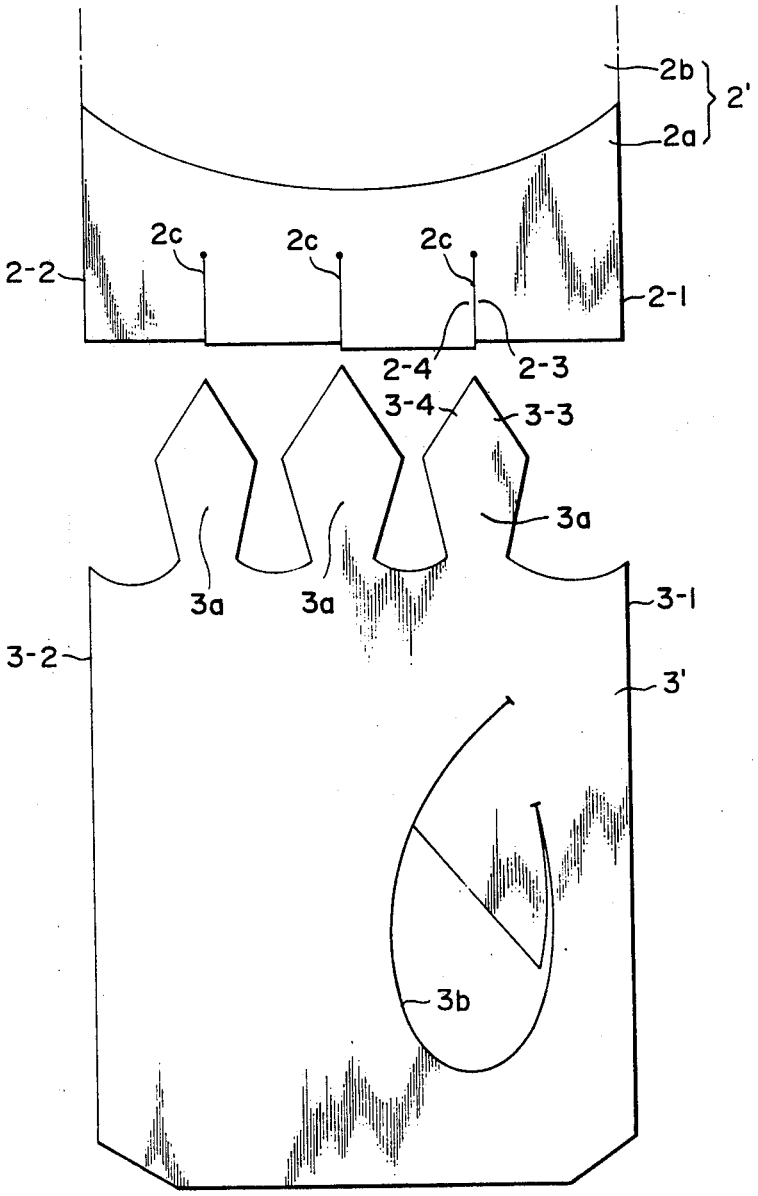
FIG. 4 is a plan view of blank material for the glove cut into a predetermined shape, before the sewing.

Then, the thumb section 4 is sewn around a thumb bore 3*b* as shown in FIG. 4 by conventional sewing methods. In addition, an elastic band 5 is sewn, also by conventional methods, to the annular lower edge of the palm and back portions which have been sewn to each other. A pair of Velcro-type fasteners 8 are secured to the back portion 2, along a slit 7 formed in the latter, so as to facilitate putting the glove on and taking it off. Two or three rubber belts 9 are sewn to the back portion 2 to make the glove snugly fit the hand.

As has been described, in the fingerless glove of the present invention, the peripheral edges of the finger-insertion bores are positioned at the base portions of the fingers excepting the thumb. Therefore, no stretching of the leather at these portions takes place and, accordingly, there is no curling into a strand as in the case of conventional gloves. In addition, the stitch or seam of the gore is not positioned on the palm portion. For these reasons, the glove of the invention can be used with an improved feel of use which is very desirable.

As to the thumbs section, it is difficult to adopt a cut structure as used for other finger portions, so that the thumb section may be made preferably to envelop the entire portion of the thumb.

What is claimed is:

1. A fingerless glove comprising a back portion having inwardly extending spaced apart slits along the upper portion thereof, a palm portion, a thumb portion secured to the palm portion, a plurality of gore tabs spaced from each other and extending from the upper edge of the palm portion, and a plurality of finger-insertion bores formed by sewing the gore tabs to the back portion at the slits thereof with each tab secured to each side of one of the slits.

2. A fingerless glove as in claim 1 wherein the gore tabs are fabricated from the same material as the palm portion and extend unitarily with and continuously from the palm portion.

3. A fingerless glove as in claim 1 wherein the peripheral edge portion of each of the finger-insertion bores is so situated as to surround the base end portion of the corresponding finger.

4. A fingerless glove as in claim 1 wherein the parts of the back portions located between the fingers are opened in the form of V-shaped notches.

5. A fingerless glove as in claim 3 wherein a stitch is provided around the peripheral edge of each finger-insertion bore.

* * * * *